US006681756B1

(12) United States Patent
Kilpatrick

(10) Patent No.: US 6,681,756 B1
(45) Date of Patent: Jan. 27, 2004

(54) ATTACHMENT FOR A PERCUSSIVE TOOL

(75) Inventor: James Kilpatrick, North Yorkshire (GB)

(73) Assignee: Power & Design Limited (GB)

( * ) Notice: Subject to any disclaimer, the term of this patent is extended or adjusted under 35 U.S.C. 154(b) by 28 days.

(21) Appl. No.: 10/048,603

(22) PCT Filed: Aug. 1, 2000

(86) PCT No.: PCT/GB00/02989

§ 371 (c)(1),
(2), (4) Date: Feb. 1, 2002

(87) PCT Pub. No.: WO01/08853

PCT Pub. Date: Feb. 8, 2001

(30) Foreign Application Priority Data

Aug. 2, 1999 (GB) ..... 9918188

(51) Int. Cl.[7] ..... B28D 1/26
(52) U.S. Cl. ..... 125/41; 125/23.01
(58) Field of Search ..... 125/40, 41, 42, 125/23.01; 30/361, 367; 175/414, 416, 415

(56) References Cited

U.S. PATENT DOCUMENTS 4,730,395 A * 3/1988 Blessing, Sr. ..... 30/360
4,848,309 A * 7/1989 Alderete ..... 125/40
5,797,189 A * 8/1998 Gilbert ..... 30/500

FOREIGN PATENT DOCUMENTS

| | | |
|---|---|---|
| FR | 2655587 | 6/1991 |
| GB | 2343402 | 5/2000 |
| WO | WO/7900771 | 10/1979 |

* cited by examiner

*Primary Examiner*—Dung Van Nguyen
(74) *Attorney, Agent, or Firm*—Beyer Weaver & Thomas LLP

(57) ABSTRACT

An attachment for a percussive tool comprises a plurality of parallel rows of teeth (10) formed along the edges of planar chisel blades (9) arranged to form a shape having rotational symmetry. The attachment is connected to a percussive tool and placed in contact with a wall (12). The tool causes percussive action of the attachment such that the chisel blades (9) form a plurality of parallel grooves (13) and ridges in the wall. The tool and attachment are then rotated through an angle and placed in contact with the wall (12) in a position overlaying the plurality of parallel grooves (13). This breaks up the ridges forming a hole (15) of a substantially uniform depth. The attachment is used to produce square holes suitable for installing wall boxes for light switches or power points.

24 Claims, 4 Drawing Sheets

ATTACHMENT FOR A PERCUSSIVE TOOL

BACKGROUND TO THE INVENTION

Part of an electrician's job is to chisel out holes in walls to receive wall boxes to accommodate power points, light switches and the like. These are generally formed by hand chiseling. Once the recess is made, the box is positioned and a mark made. The box is then removed and a hole drilled at the position of the mark for receiving a wall plug for the fixing screw for attaching the box to the wall. This is time consuming, particularly if a number of boxes must be fitted, for instance in a newly built house. These boxes are generally square or rectangular but may be other shapes, such as conduit boxes which are cylindrical and therefore require circular holes.

DISCLOSURE OF THE INVENTION

According to the present invention an attachment for a percussive tool comprises:

means for connecting the attachment to a percussive tool; and a plurality of rows of teeth arranged substantially parallel to and spaced from each other to form a shape substantially having rotational symmetry about a central axis.

According to a second aspect of the present invention, a method for forming a hole in a wall comprises the steps of:

providing an attachment for a percussive tool having a plurality of rows of teeth arranged substantially parallel to and spaced from each other to form a shape substantially having rotational symmetry about a central axis;

connecting the attachment to a percussive tool;

placing the attachment in contact with the wall and causing percussive action of the attachment such that the rows of teeth form a plurality of parallel grooves and ridges in the wall; and rotating the attachment through an angle about the central axis and placing the attachment in contact with the wall in a position overlaying the plurality of parallel grooves and causing percussive action of the attachment to break up the ridges and form a hole of a substantially uniform depth.

The teeth may be individual projections, but preferably the teeth are formed as saw tooth shaped projections along the edges of parallel planar chisel blades.

The parallel planar blades create a series of parallel grooves in the wall and the attachment is then rotated through an angle and applied again to break up the ridges between the grooves to remove an area of wall in the shape of the attachment. For an attachment shape having N-fold rotational symmetry, the attachment must be rotated through approximately 360°/N, or a multiple thereof, such that the outline of the second cut overlays the first, but the grooves formed by the blades cross those formed by the first cut. The debris is ejected through the spaces between the chisel blades. Means may be provided to limit the depth to which the hole is chiseled, for instance a projection may be provided on the edge of the attachment. This allows a hole of a predetermined depth to be produced. Slots may be provided in the back of the device between the chisel blades to allow debris to more easily be ejected.

The saw tooth shaped projections along each blade improve the cutting ability of the attachment and also allow the debris produced to more easily be ejected from under the attachment. They reduce the contact area of the attachment on the wall, compared to the contact area of blades having continuous edges, which allows the attachment to be used with more lightweight, less powerful tools. The spacing of the blades and the pitch of the teeth may be chosen to match the power of the tool.

The attachment of the present invention may be designed to produce holes of a variety of shapes having rotational symmetry. For instance, the parallel chisel blades may vary in length such that the whole tool has a circular formation. Rotating such an attachment through any angle less than 180° for the second cut would result in a circular hole. For producing a hole in the shape of an equilateral triangle, the tool must have an equilateral triangular shape and the rotation must be through 120° such that the second cut overlays the first cut. However, preferably the chisel blades are arranged to form a square and the attachment is rotated through 90° to form a square hole.

Preferably, the attachment comprises an attachment head and a drive impact shaft. Preferably the means for connecting the attachment to a percussive tool comprises a standard fitting such as an SDS fitting, an SDS Max fitting, or similar chucks used on percussive power tools, or other means to connect to the percussive tool. Therefore, by providing drive impact shafts having a variety of standard fittings the attachment may be fitted to the chuck of almost any percussive tool such as a so called combie drill or impact breaker. Preferably the drive impact shaft is connected to the attachment head by means of a taper fit. Preferably, locking means are provided to lock the taper fit in engagement. A number 2 Morse taper angles are preferably used and the head of the tool is retained by a centralizing and locking screw. The shaft may be released by removing the locking screw and using a parallel punch of a smaller diameter than the screw thread against the base of the screwed hole in the shaft.

With the above described arrangement, the attachment head may be readily replaced when it is worn by detaching it from the drive impact shaft. Preferably, the attachment is formed from hard cast metal formed by an investment casting operation. It is therefore straightforward to manufacture and replace when worn.

Preferably, the attachment also includes a locating rod protruding from the centre of the attachment head beyond the extent of the chisel blades. Preferably the locating rod screws into the end of the drive impact shaft and provides the means for locking the taper fit. The locating rod may be used to locate the device by locating the rod in a pre-drilled hole whilst forming the first set of parallel grooves to locate the attachment as it is rotated through 90°. This therefore ensures that the second cut overlays the first and the hole is the correct shape. The rod also may serve to limit the depth of the hole chiseled when it reaches the bottom of the pre-drilled hole. The pre-drilled hole is drilled using a standard electric drill and is there to be used as a hole for a plastic wall plug for a fixing screw for fixing the box to the wall.

Often, a hole is required which is not square but rectangular, for instance a hole for a double power point. This can readily be achieved with the device of the present invention by forming a second square hole adjacent to or partly overlapping the first. Means may be provided to aid in location of the second square hole such as a template which fits into the first square hole and carries a guide for locating the pre-drilled hole for locating the second square hole. In general, double wall boxes are of the same height as the single wall boxes and therefore the same attachment may be used to form rectangular holes for double wall boxes.

The present invention is particularly suited for use in an electric hand tool capable of percussive action such as a Combie drill or impact breaker. However, it may also be used with a pneumatic percussive tool.

BRIEF DESCRIPTION OF THE DRAWINGS

An embodiment of the present invention will now be described with reference to the accompanying drawings in which.

DESCRIPTION OF A PREFERRED EMBODIMENT

Figure 1:
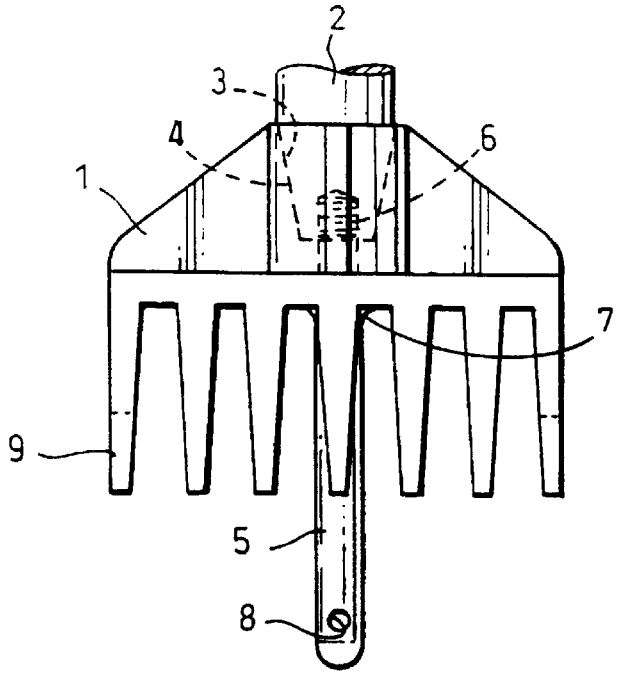
FIG. 1 shows a partly cross sectioned side elevation of an embodiment of the present invention.

FIGS. 1, 2, 5 and 6 show an attachment according to an embodiment of the invention. The attachment head 1 is attached to a drive impact shaft by means of a taper 3;4. A locating rod 5, having a screw thread 6 on one end, passes through a hole in the attachment head 1 and screws into the end of the drive impact shaft 2. A flange 7 engages the edge of the hole in the attachment head 1 and the taper 3,4 is locked in engagement. The attachment head 1 can therefore readily be removed from the drive impact shaft 2 by unscrewing the locating rod 5. This allows easy replacement of the attachment head 1 when it becomes worn, or if a different size head is required. The locating rod 5 includes a hole 8 at its end for inserting a rod or key for easy unscrewing of the locating rod 5 from the drive impact shaft 2. The drive impact shaft 2 is attached to a portable electric combie drill or impact breaker by means of a standard SDS Max attachment. However, the same attachment head 1 may be fitted to a drive impact shaft having a different fitting for attachment to a drill having a different type of fitting such as a three jaw chuck.

As shown in FIG. 1, the attachment head 1 comprises seven parallel chisel blades 9. In this embodiment, the chisel blades are spaced at approximately 13 mm, such that the width of the attachment is 80 mm. This is the standard size of a wall box for a light switch or power point. The locating rod 5 protrudes beyond the extent of the chisel blades 9.

Figure 2:
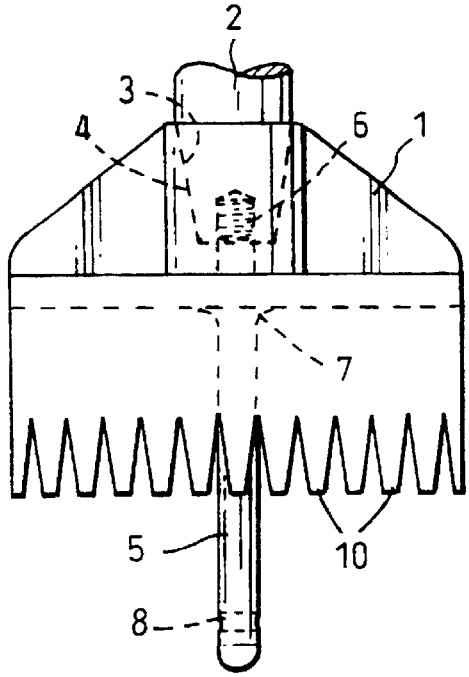
FIG. 2 shows a partly cross sectioned side elevation of the embodiment of the present invention rotated through 90° with respect to FIG. 1.

FIG. 2 shows the attachment of FIG. 1 rotated through 90°. Each chisel blade 9 has a plurality of saw tooth shaped projections 10 along its cutting edge. This improves the cutting ability of the attachment and also allows the debris to be expelled easily from under the blades 9 when the attachment is in use. The length of the attachment is also 80 mm.

Figure 5:
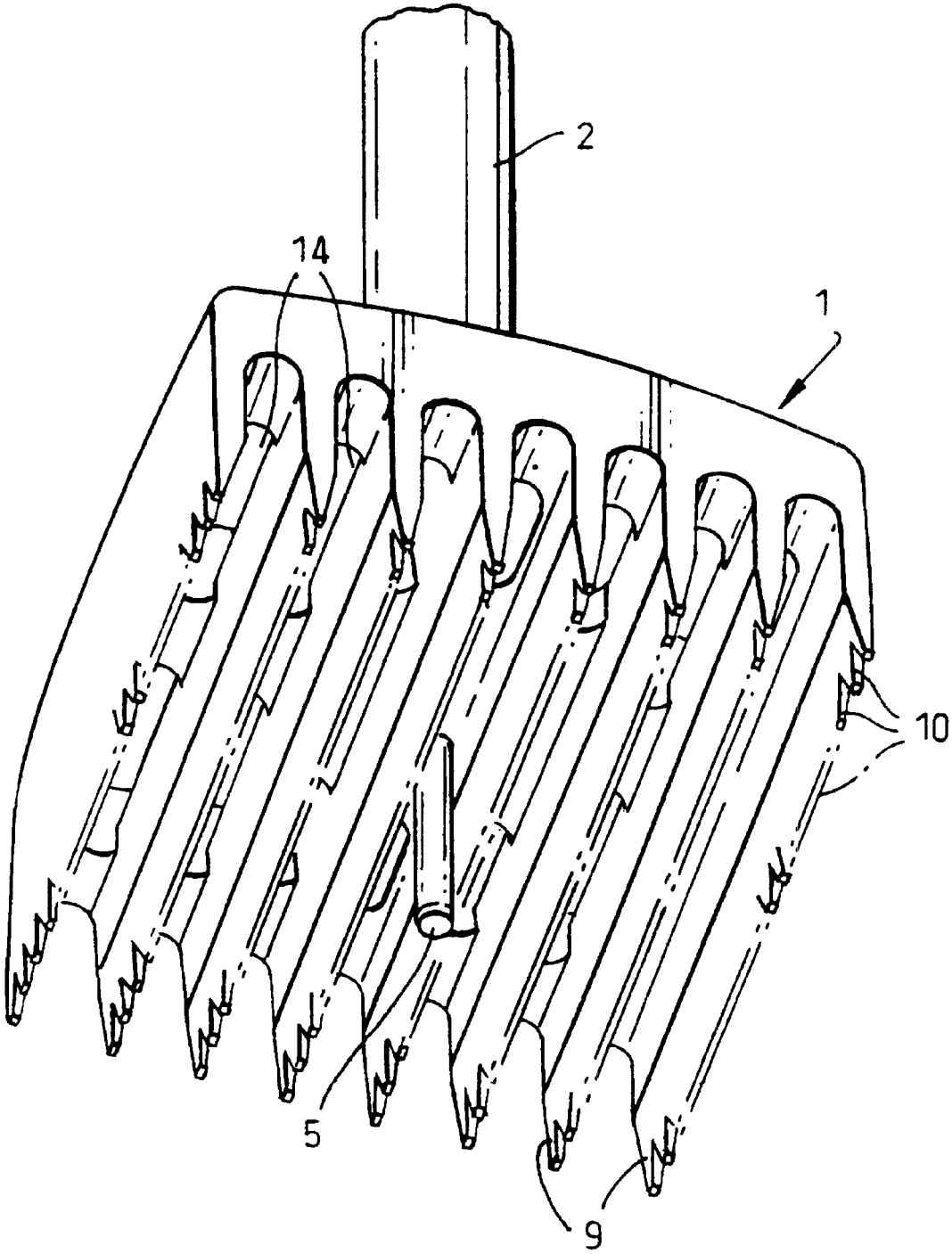
FIG. 5 shows an elevation showing the cutting face of the embodiment of the present invention.
Figure 6:
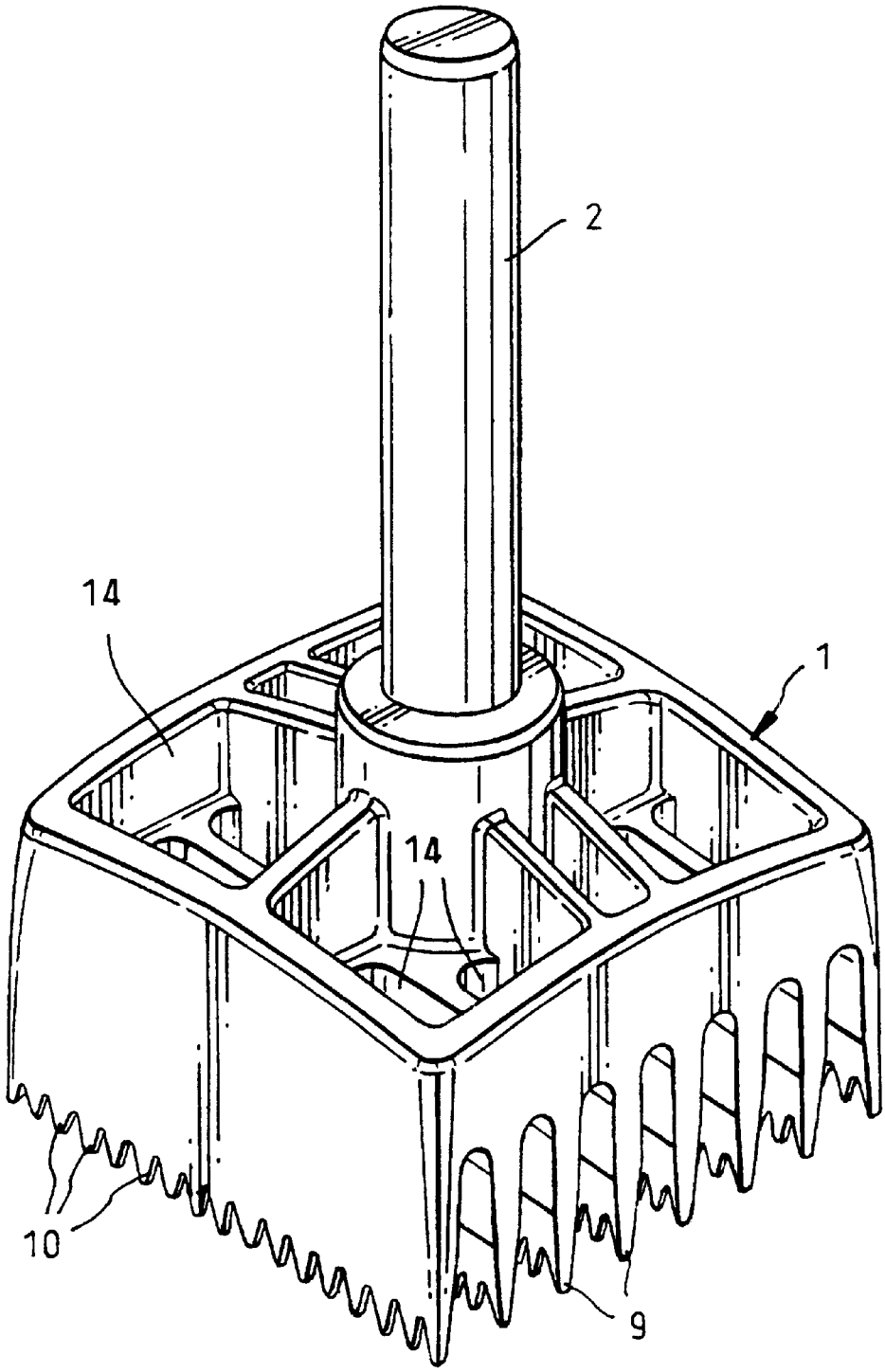
FIG. 6 shows a side elevation of the embodiment of the present invention.

As illustrated in FIGS. 5 and 6, the attachment includes slots 14 formed in its back between the chisel blades 9 for allowing debris to be expelled.

Figure 3:
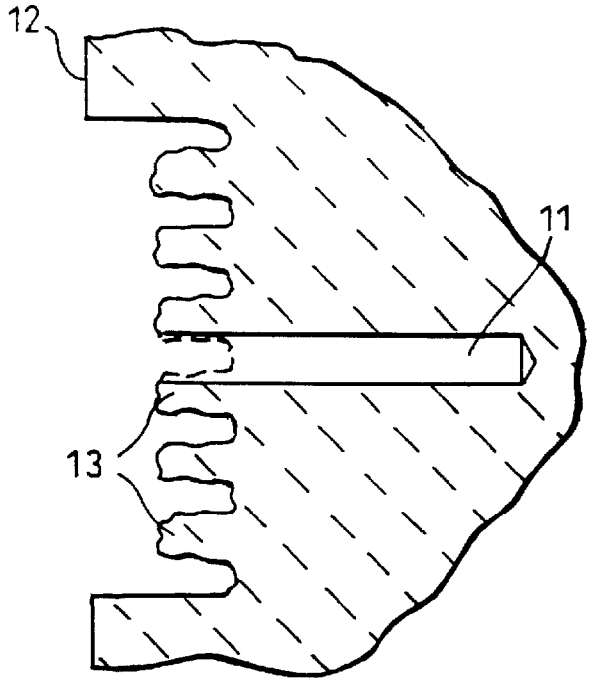
FIG. 3 shows a cross section of a wall after a first cut with the attachment of FIGS. 1 and 2.
Figure 4:
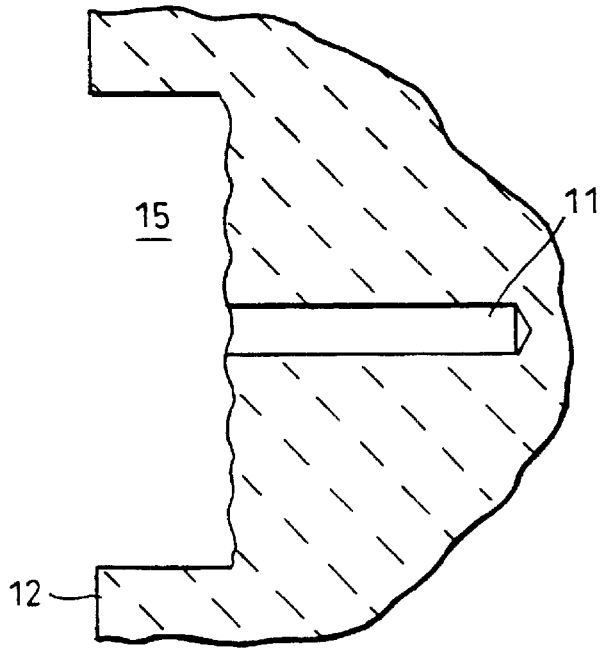
FIG. 4 shows a cross section of a wall having a hole formed in accordance with a method according to the present invention.

FIGS. 3 and 4 illustrate the how the attachment is used to form a square hole 15 for receiving a wall box for a power point or light switch. First, a hole 11 is drilled using a standard drill. The hole 11 is used to receive the locating rod 5. As the locating rod 5 enters the hole 11, the chisel blades 9 come into contact with the wall 12, cutting parallel grooves 13, as shown in FIG. 3. The depth of the hole formed in the wall may be determined either by when the locating rod 5 reaches the bottom of the hole 11, or by the depth of the attachment itself.

The drill and attachment are then rotated through 90°, and, locating the rod 5 in the hole 11, a second cut is made. The ridges between the parallel grooves 13 crumble under the chisel blades 9 and the debris falls out through the gaps between the chisel blades 9. The necessary spacing of the chisel blades 9 is dependent on the material in which the hole is to be chiseled. If the spacing is too great, the second cut will result in a criss cross pattern of cuts rather than cause the ridges between the parallel grooves 13 to crumble. Material such as plaster which crumbles easily will not require as closely spaced chisel blades 9 as a harder material such as concrete. If the material is very soft a single cut may be sufficient to create a hole and the second cut may not be required. The present inventors have found that a spacing of between 10 mm and 13 mm is suitable for most materials.

What is claimed is:

1. An attachment for a percussive tool comprising:

means for connecting the attachment to a percussive tool; and a plurality of rows of teeth arranged substantially parallel to and spaced apart from each other to form a shape substantially having rotational symmetry about a central axis, wherein each tooth is formed in one of said rows and wherein each row of teeth is formed along the edge of a planar chisel blade.

2. An attachment for a percussive tool according to claim 1, wherein the parallel rows of teeth are arranged to form a square.

3. An attachment for a percussive tool according to claim 2, said attachment further comprising:

a locating rod protruding from the attachment along the central axis beyond the extent of the teeth.

4. An attachment for a percussive tool according to claim 3, wherein the attachment includes an attachment head and a drive impact shaft.

5. An attachment for a percussive tool according to claim 4, wherein the attachment head is connected to the drive impact shaft by means of a taper fit.

6. An attachment for a percussive tool according to claim 5, wherein locking means are provided for holding the taper fit in engagement.

7. An attachment for a percussive tool according to claim 6, wherein the locking means for holding the taper fit in engagement includes the locating rod which screws into the end of the drive impact shaft.

8. An attachment for a percussive tool according to claim 2, wherein the attachment includes an attachment head and a drive impact shaft.

9. An attachment for a percussive tool according to claim 8, wherein the attachment head is connected to the drive impact shaft by means of a taper fit.

10. An attachment for a percussive tool according to claim 9, wherein locking means are provided for holding the taper fit in engagement.

11. An attachment for a percussive tool according to claim 10, wherein the locking means for holding the taper fit in engagement includes the locating rod which screws into the end of the drive impact shaft.

12. An attachment for a percussive tool according to claim 1, said attachment further comprising:

a locating rod protruding from the attachment along the central axis beyond the extent of the teeth.

13. An attachment for a percussive tool according to claim 12, wherein the attachment includes an attachment head and a drive impact shaft.

14. An attachment for a percussive tool according to claim 13, wherein the attachment head is connected to the drive impact shaft by means of a taper fit.

15. An attachment for a percussive tool according to claim 14, wherein locking means are provided for holding the taper fit in engagement.

16. An attachment for a percussive tool according to claim 15, wherein the locking means for holding the taper fit in engagement includes the locating rod which screws into the end of the drive impact shaft.

17. An attachment for a percussive tool according to claim 1, wherein the attachment includes an attachment head and a drive impact shaft.

18. An attachment for a percussive tool according to claim 17, wherein the attachment head is connected to the drive impact shaft by means of a taper fit.

19. An attachment for a percussive tool according to claim 18, wherein locking means are provided for holding the taper fit in engagement.

20. An attachment for a percussive tool according to claim 19, wherein the locking means for holding the taper fit in engagement includes the locating rod which screws into the end of the drive impact shaft.

21. A method for forming a hole in a wall comprising:

providing an attachment for a percussive tool, said attachment having a plurality of rows of teeth arranged substantially parallel to and spaced apart from each other to form a shape substantially having rotational symmetry about a central axis;

connecting the attachment to a percussive tool;

placing the attachment in contact with the wall and causing percussive action of the attachment such that the rows of teeth form a plurality of parallel grooves and ridges in the wall; and rotating the attachment through an angle about the central axis and placing the attachment in contact with the wall in a position overlaying the plurality of parallel grooves and ridges and causing percussive action of the attachment to break up the ridges and form a hole of a substantially uniform depth.

22. A method for forming a hole in a wall according to claim 21, said method further comprising:

first drilling a circular hole in the wall;

providing a locating rod on the central axis of the attachment protruding beyond the extent of the teeth;

locating the rod in the circular hole whilst forming the first set of parallel grooves; and locating the rod in the circular hole to locate the attachment as it is rotated.

23. A method for forming a hole in a wall according to claim 22, wherein the method is repeated partly overlapping the first hole to form a larger hole.

24. A method for forming a hole in a wall according to claim 21, wherein the method is repeated partly overlapping the first hole to form a larger hole.

* * * * *